US005979289A

United States Patent [19]

French

[11] Patent Number: 5,979,289

[45] Date of Patent: Nov. 9, 1999

[54] APPARATUS FOR AND METHOD OF DETONATING MINES

[75] Inventor: John Robert French, Melton Mowbray, United Kingdom

[73] Assignee: J R French Limited, United Kingdom

[21] Appl. No.: 09/029,355

[22] PCT Filed: Aug. 20, 1996

[86] PCT No.: PCT/GB96/02030

§ 371 Date: Apr. 13, 1998

§ 102(e) Date: Apr. 13, 1998

[87] PCT Pub. No.: WO97/08508

PCT Pub. Date: Mar. 6, 1997

[30] Foreign Application Priority Data

| | | | |
|---|---|---|---|
| Aug. 24, 1995 | [GB] | United Kingdom | 9517345 |
| Dec. 14, 1995 | [GB] | United Kingdom | 9525527 |

[51] Int. Cl.[6] ..... B64D 1/04; B63G 9/00

[52] U.S. Cl. ..... 89/1.13; 102/402

[58] Field of Search ..... 89/1.13, 1.11; 102/402, 403

[56] References Cited

U.S. PATENT DOCUMENTS

| | | | |
|---|---|---|---|
| 1,750,586 | 3/1930 | Field et al. | 89/1.13 |
| 1,841,802 | 1/1932 | Gettelman | 89/1.13 |
| 2,425,018 | 8/1947 | Williams . | |
| 2,460,322 | 2/1949 | Walker . | |
| 3,771,413 | 11/1973 | Sieg et al. | 89/1.13 |
| 4,667,564 | 5/1987 | Schreckenberg | 89/1.13 |
| 5,183,119 | 2/1993 | Wattenburg | 89/1.13 |
| 5,313,868 | 5/1994 | Wolf | 89/1.13 |
| 5,706,899 | 1/1998 | Klebanov | 89/1.13 |

FOREIGN PATENT DOCUMENTS

| | | | |
|---|---|---|---|
| 0 190 510 | 8/1986 | European Pat. Off. . | |
| 921510 | 5/1947 | France . | |
| 994814 | 11/1951 | France | 89/1.13 |
| 996084 | 12/1951 | France . | |
| 2 233 590 | 10/1975 | France . | |
| 962850 | 7/1964 | United Kingdom . | |

*Primary Examiner*—Charles T. Jordan
*Assistant Examiner*—Theresa M. Wesson
*Attorney, Agent, or Firm*—Young & Basile, P.C.

[57] ABSTRACT

An apparatus for and method of detonating unexploded mines is disclosed. A ground-engaging foot is caused to reciprocate by power means with sufficient force to activate an unexploded mine. Control means is used to control the manner of reciprocation of the foot by controlling the power applied to the foot. A shock absorption arrangement absorbs shock energy created upon detonation of an unexploding mine. Preferably the apparatus is vehicle mounted for example upon a remotely controlled tracked vehicle.

25 Claims, 8 Drawing Sheets

APPARATUS FOR AND METHOD OF DETONATING MINES

BACKGROUND OF THE INVENTION

The present invention relates to apparatus for and a method of detonating mines.

After wars it is often difficult to locate precisely active mines, particularly those mines distributed indiscriminately by retreating armies. Some four hundred million mines have been sold throughout the world with various estimates to the exact numbers in place (The United Nations estimate 100 million). Most mine detection and destruction equipment has been developed for the military. This equipment is designed mainly to allow armies to breach mine files quickly. To this end, the military accepts that all mines will not be destroyed by the equipment and a certain number of casualties may result.

Furthermore the methods used to detect and destroy mines cause considerable damage to the local environment. While this damage may be acceptable to the military it is not acceptable to civilian administrations. The use of military equipment to clear mines also adds considerably to the costs.

At present the only way to ensure a high level of clear up rate is for people to prod the ground carefully with sticks until they locate a mine which can then be defused. This procedure to say the least is hazardous and slow. In Afghanistan it is estimated that this clearance method will take at least another hundred years to clear existing mines. Add to this the need to identify the boundaries of the relevant minefields and the time element is further increased.

For Non-Government-Organizations (NGO's) to use military equipment is often outside their budget and as previously stated the equipment does not give a high enough success rate.

GB 2 132 567A describes vibration apparatus for mine disposal. The vibration apparatus is mounted by an arm to a powering vehicle, the arm being in two portions joined by frangible means which separate in the event of an explosion.

SUMMARY OF THE INVENTION

In accordance with the broadest aspect of the present invention, there is provided apparatus for detonating a mine comprising a ground-engaging foot, power means for reciprocating said foot, control means for controlling the application of power to the foot and thus the manner of reciprocation of the foot and means for absorbing shock energy created upon detonation of an exploding mine.

The foot may be a solid component such as a plate typically of metal or reinforced plastics. Alternatively, the foot may be in the form of a grid or mesh and may be provided with ground-penetrating spikes or prods.

The means for causing the foot to reciprocate is conveniently a piston and ram assembly, the foot being attached to the end of the ram. The foot may be fixed to the ram or pivotally mounted to it. The foot may be removably secured to the ram, for example by bolts or pins, to enable a foot to be replaced more readily in the event of foot damage. The piston and ram assembly may be pneumatically or hydraulically operable.

In a preferred embodiment of the invention a plurality of piston and ram assemblies are mounted in side-by-side relationship upon a common support or frame. The assemblies are conveniently in locked, abutting relationship between opposed ends of the frame. Movement of the feet attached to the rams is a synchronous being determined from a control unit.

The apparatus is typically vehicle mounted, for example upon a remotely controlled tracked vehicle. Suitable armor may be placed on the vehicle in and around the apparatus to protect the vehicle during demining.

In accordance with another aspect of the invention there is provided a method of detonating a mine comprising supplying power to reciprocate a ground-engaging foot in such a manner that each time the foot strikes the ground it does so with sufficient force to activate a mine, controlling the application of power to the foot and thus the manner of reciprocation of the foot, and absorbing shock energy created by an exploding mine to minimise damage to the ground-engaging foot and other parts of the detonation equipment.

BRIEF DESCRIPTION OF THE DRAWINGS

The invention will now be described further by way of example with reference to the accompanying drawings in which.

DETAILED DESCRIPTION OF THE INVENTION

Figure 1:
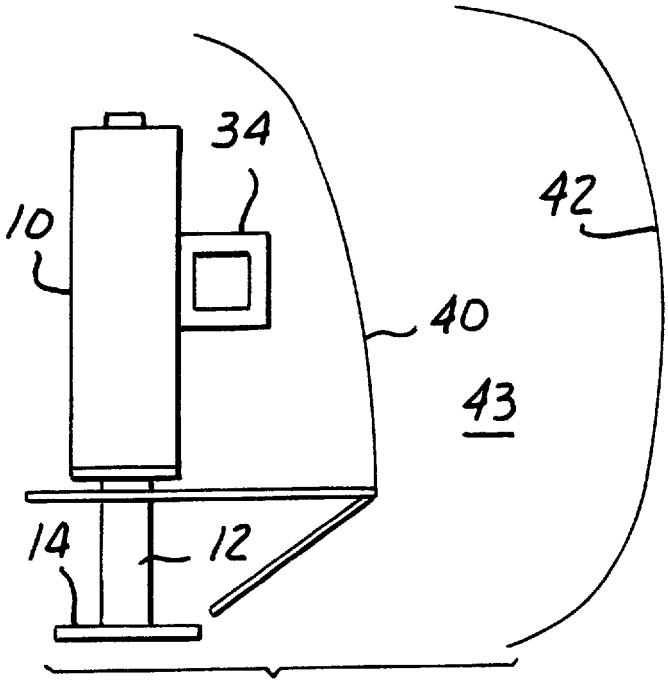
FIG. 1 is a diagrammatic side elevation of an apparatus in accordance with a first embodiment of the invention which includes a single piston and ram assembly and incorporates a foot.
Figure 2:
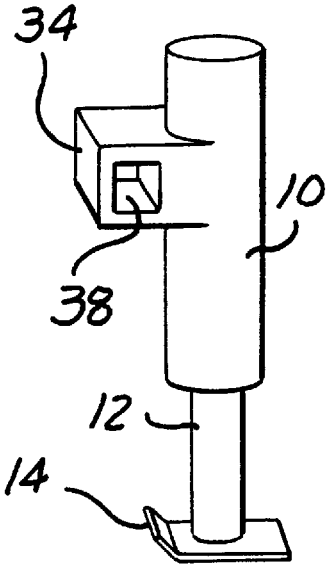
FIG. 2 is a perspective view of the apparatus illustrated in FIG. 1.

The piston and ram assembly illustrated in FIGS. 1 to 4 consists of a housing or cylinder 10 within which a ram 12 is mounted for reciprocation in known manner. The lower end of the ram rod 12 carries a metal ground-engaging foot 14 which is fixed to the ram. The size of the foot depends upon the size of the ram but is typically 110 mm×75 mm (4 inches×3 inches). The upper end of the cylinder 10 has a valved inlet aperture 16 to which a pneumatic line 18 is connected. Compressed air is supplied to the line 18 via a synchronous control unit (not shown).

A freely-mounted piston 20 is slidably received within the cylinder 10, its upper surface 22 being exposed to compressed air introduced through the aperture 16 and its lower surface 24 being engageable intermittently with a disc 26 or flange mounted on the inner end of the ram 12. An exhaust valve 28 is mounted in the cylindrical side of the cylinder 10 approximately one third of the distance from the upper end of the cylinder 10, as viewed.

A compression spring 30 is located around the ram 12 between the end wall 32 of the cylinder 10 and the underside of the disc 26. The function of the spring 30 is to prevent impact damage between the disc 26 and the end wall 32.

Figure 4:
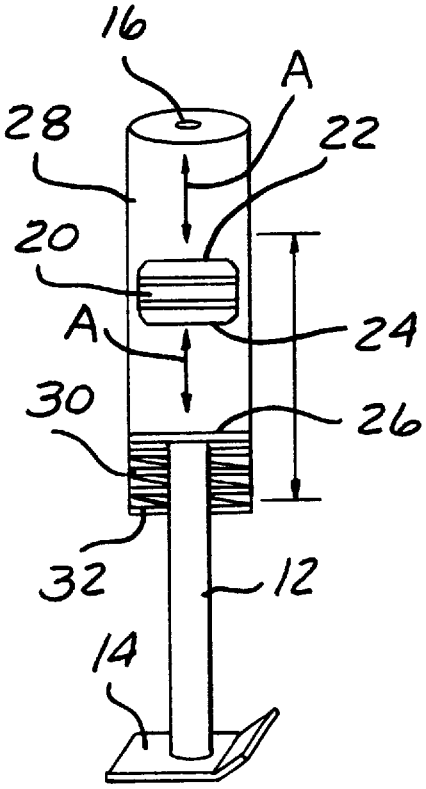
FIG. 4 is a sectional view of the apparatus illustrated in FIGS. 1 to 3.
Figure 3:
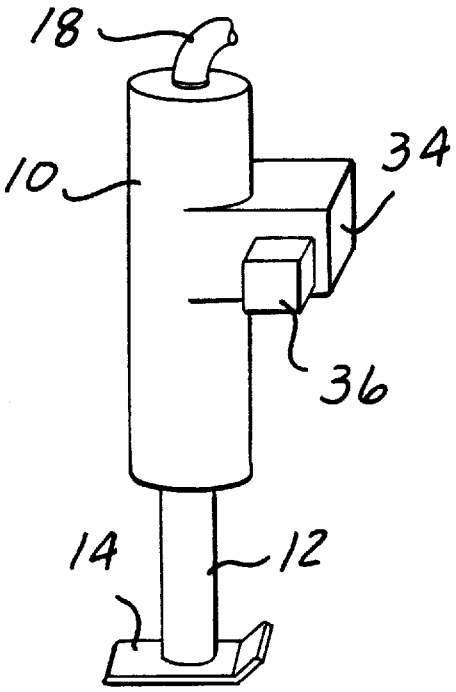
FIG. 3 is a similar view to FIG. 2 but illustrating the locking arrangement.

In use, as best seen from FIG. 4, a pulse of compressed air is applied to the upper surface 22 of the piston 20 thus causing the piston to move downwardly within the cylinder 10 for the extend indicated by the arrows 'A' into contact with the disc 26. Further downward movement continues against the pressure of the spring 30. As the pulse declines the pressure above the piston 20 is reduced so that the ram 12 rises within the cylinder 10, excess pneumatic pressure being vented through the exhaust valve 28. As a series of pulses of compressed air is applied to the upper piston surface 22, the ram foot 14 is provided with an action simulating that of a stamping human foot. This action stamps or strikes the ground with sufficient force to activate a mine. Dependent upon the type and make of mine, a typical force is in the range 1 kg to 400 kg.

The or each single piston and ram assembly must be rigidly mounted during use such as by locking or clamping the assembly to a support described later.

An armor plate shield 40 is shown diagrammatically in FIG. 1 immediately behind a piston and ram assembly or a series thereof (see FIG. 5) and a further and preferably larger such shield 42 is mounted a distance behind the first shield 40 so as to provide a mine detonation blast area 43 between them. The shields 40, 42 are profiled, for example curved, so as to direct any blast upwardly and forwardly to avoid or minimise local damage or injury and to largely prevent the blast being contained between the shields 40, 42. Further, in this regard the side edges of the shields may be forwardly curved or inclined and/or additional side shielding provided in order to direct lateral blast forwardly. The shields also serve to contain the shrapnel (e.g. steel balls) of "bounding" mines.

In the event of a mine being exploded by the ground-engaging foot 14, a primary shock-absorption system comes into operation. Thus, the force of the explosion drives the foot and piston upwards rapidly. For the first two-thirds of its upward movement within the cylinder 10 the piston encounters no resistance since the volume of air above the piston is vented through the exhaust valve 28. It is this first free, unimpeded movement which absorbs the initial impact of the explosion. However, once the piston 24 has risen sufficiently in the cylinder 10 to cover the exhaust valve 28, further upward movement of the piston 10 compresses the air above the piston thus slowing the piston and enabling blast from the explosion to be absorbed.

Figure 5:
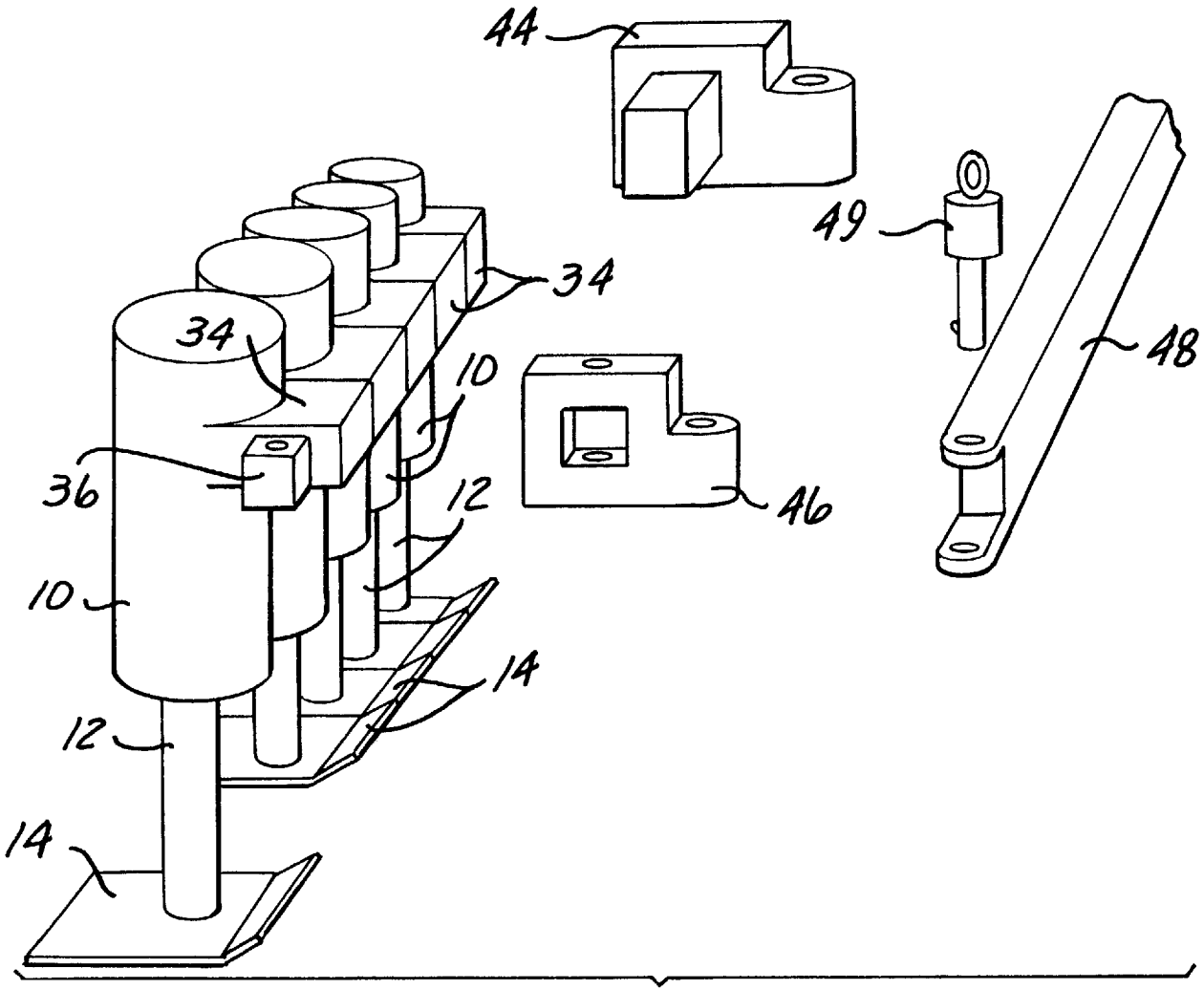
FIG. 5 is a partly exploded view illustrating an apparatus in accordance with a second embodiment of the invention which incorporates a plurality of piston and ram assemblies.

FIG. 5 shows the use of a plurality or series of piston and ram assemblies of the type illustrated in FIGS. 1 to 4 secured together side-by-side. For this purpose each cylinder 10 is provided with a lateral projection 34 which carries a male insert 36 on one side and a corresponding female recess 38 on the other side (see FIGS. 2, 3 and 5). The male insert 36 of one cylinder 10 engages in the female recess 38 of an adjacent cylinder 10 in locating the cylinders together in a rigid manner and enabling a series of cylinders 10 to be built up as required.

Male and female end plates 44, 46 (FIG. 5) are placed on either end of the overall assembly, which plates are then secured to respective ends of a locking and support bar 48 by locking pins 49. The bar 48 may be adjustable or extendable to accommodate different numbers of side by side cylinders 10. The foremost cylinder 10 of the series shown in FIG. 5 has its ram rod 12 and foot 14 downwardly extended in an operative mode.

In the embodiment shown in FIG. 5, the pistons of the ram assemblies are operated or fired asynchronously to reduce reaction forces on the bar 48 (or other suitable support) and also to limit possible blast damage from an exploding mine. In use, the whole assembly is passed over ground to be cleared of ordnance, the passage being at such a speed that each part of the ground swept is struck at least twice. To cope with rough ground the piston 20 operates the ram 12 downwardly which then has sufficient free travel to enable it to accommodate variations in ground level. The apparatus will cope with objects and terrain variations of up to say 55 cms but a longer ram travel can be provided thus increasing terrain variation capacity.

Figure 6:
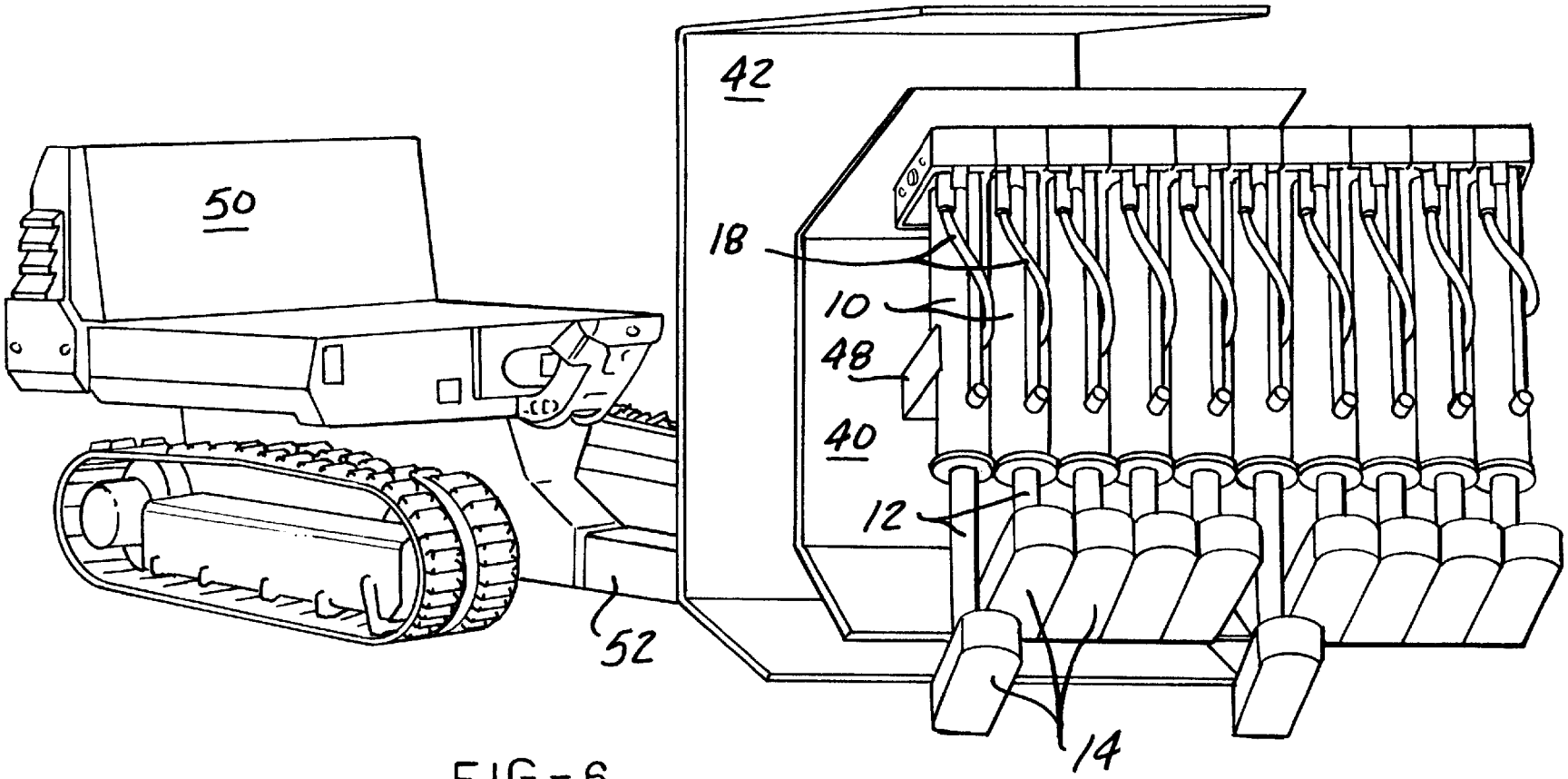
FIG. 6 is a schematic perspective view of a vehicle propelled arrangement of the embodiment shown in FIG. 5.

In FIG. 6 the apparatus of FIG. 5 is mounted upon the front of a remote controlled track laying vehicle 50 to enable the apparatus to be operated on a continuous basis until the vehicle 50 has covered all the ground to be swept.

A forwardly extending arm 52 (or similar support) carries the apparatus of FIG. 5 at its free, outer end including the front and rear armor plate shields 40, 42 illustrated in FIG. 1. The vehicle 50 may be counterweighted at its rear end. Whereas the vehicle 50 is tracked partly because of the substantial weight of the whole apparatus, the vehicle could also be mounted on metal wheels or rollers capable of coping not only with difficult terrain but also with blast damage.

Pneumatic or hydraulic fluid under pressure to the cylinders 10 is supplied by a compressor or pump (not shown) which may be conveniently carried by and driven from the vehicle 50. Pipe work from the compressor to the cylinders 10 may be protectively carried by the forwardly extending arm 52 i.e. against detonation blast. In FIG. 6, two of the rams 12 and their feet 14 are shown in a lowered ground striking position although the overall apparatus is shown in the raised position to facilitate turning of the vehicle.

Figure 7:
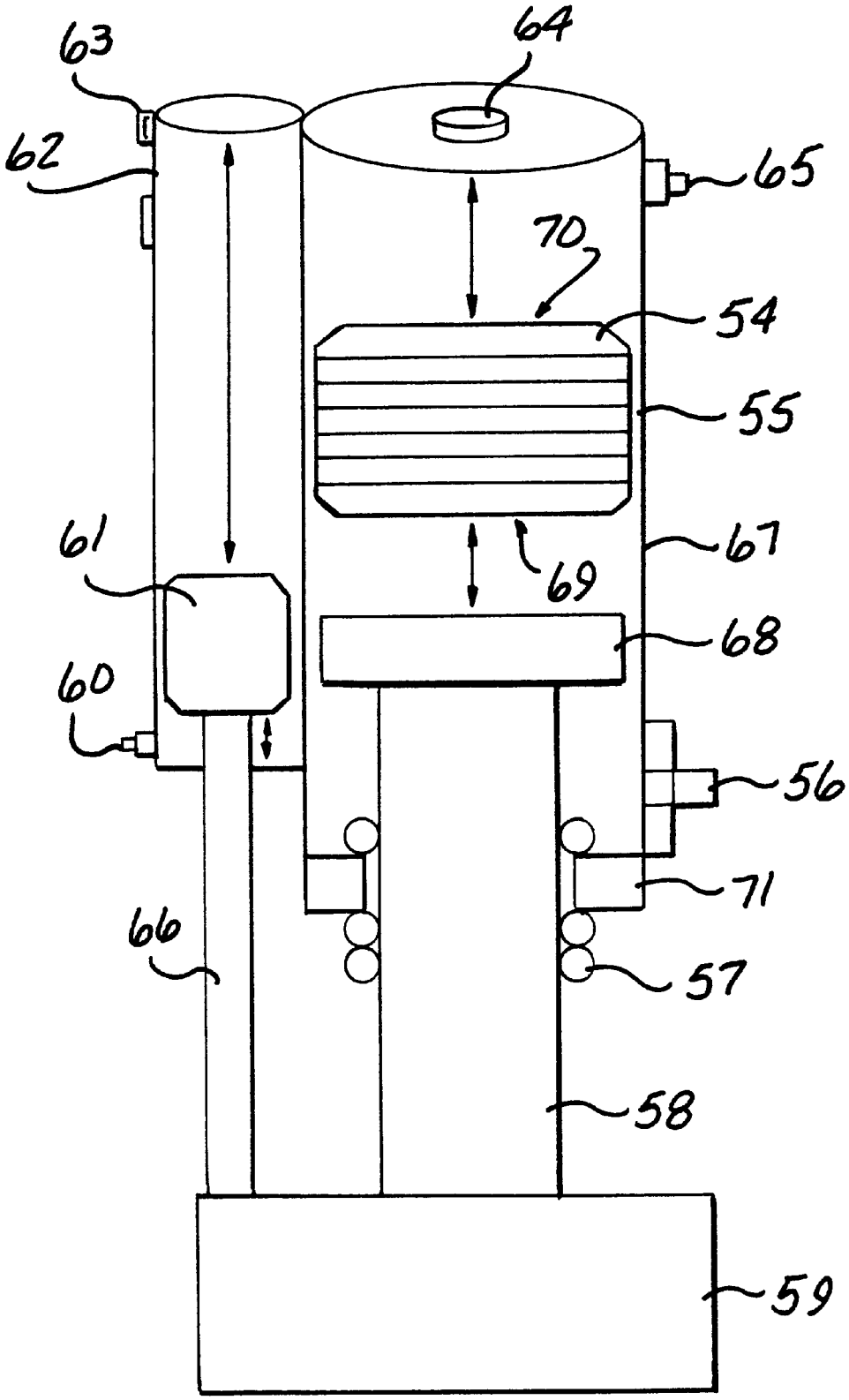
FIG. 7 is a view corresponding to that of FIG. 4, but of an apparatus in accordance with a third embodiment of the invention incorporating a variable weighted ground-engaging foot.

The embodiment illustrated in FIG. 7 consists of a housing or cylinder 67 within which a ram 58 is mounted for reciprocation or pounding in the manner described above. The lower end of the ram 58 carries a variable weighted metal foot 59 which is connected to the ram 58.

It will be appreciated that the embodiment of FIG. 7 can be built up into a plurality of assemblies and be mounted on a remote controlled vehicle in a manner similar to that illustrated in FIG. 6.

Figure 8:
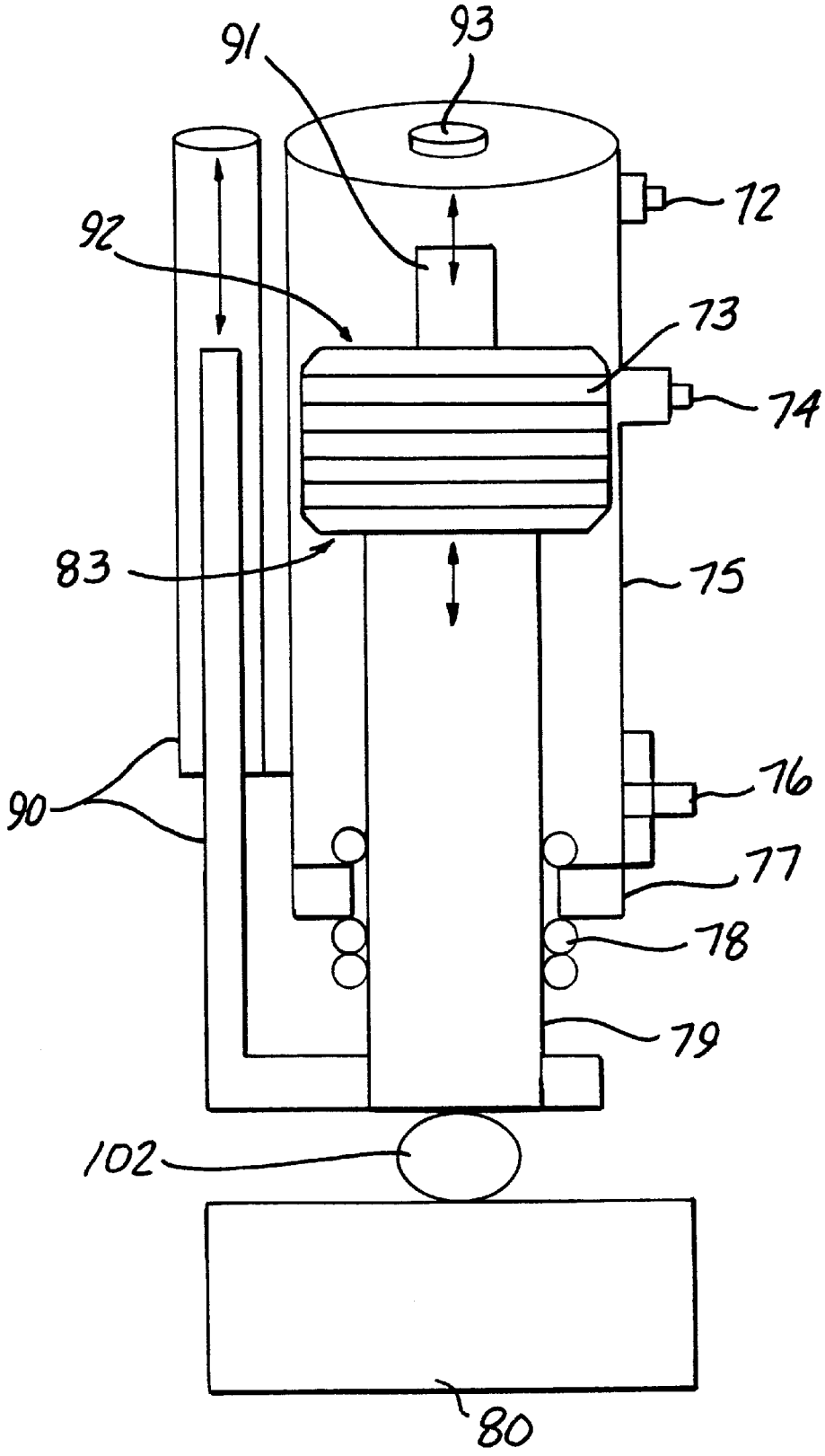
FIG. 8 illustrates diagrammatically a fourth embodiment of the invention which incorporates a swivelable variable weighted ground-engaging foot.
Figure 9:
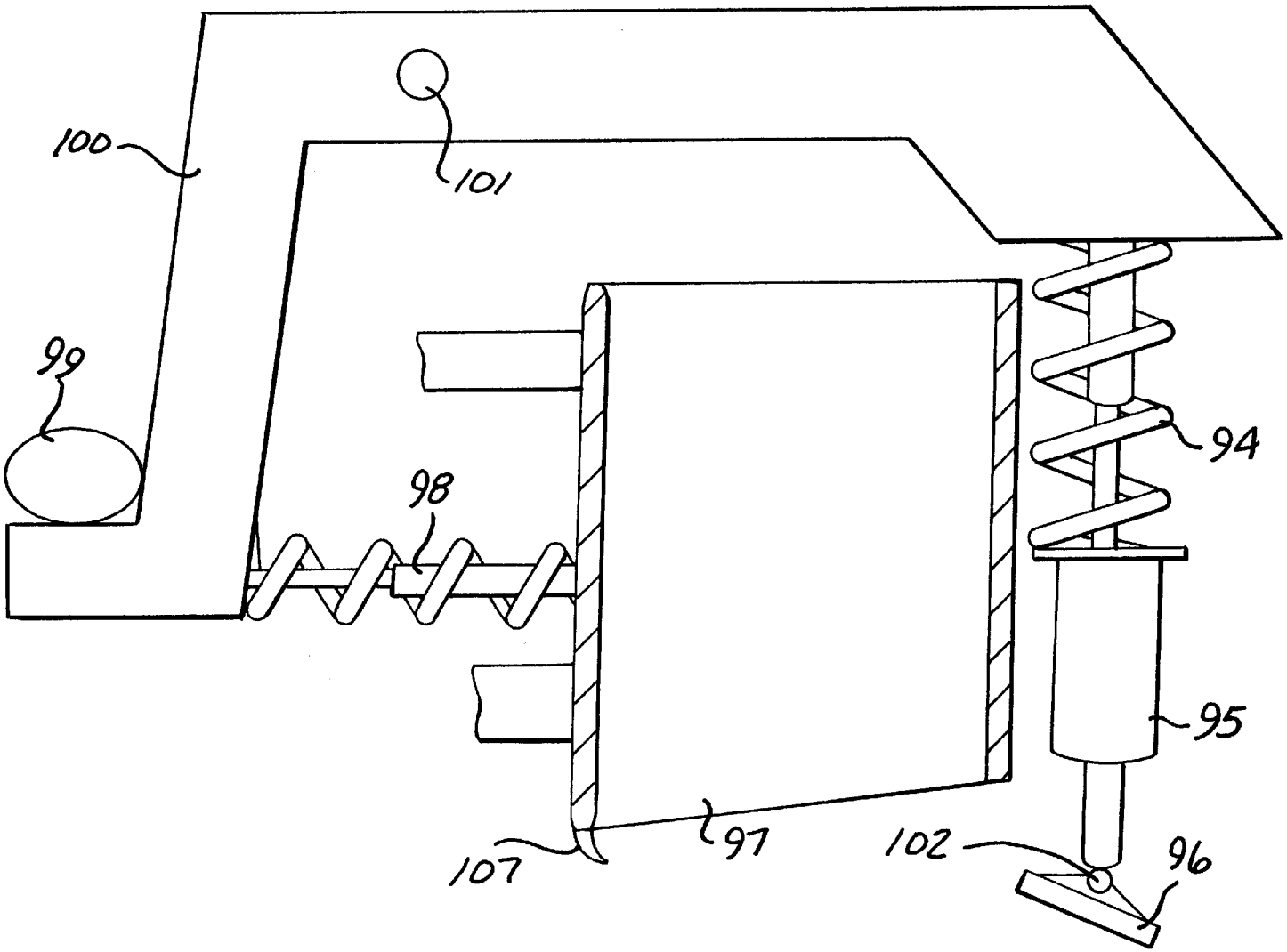
FIG. 9 illustrates diagrammatically and partly in section an apparatus in accordance with a fifth embodiment of the invention.

The foot 59 may be fitted in various configurations and sizes to suit the application, terrain and prevailing circumstances. For example, the foot 59 can swivel, angle or pivot when used against a bounding mine or anti-tank projectiles which are fired upwards and need to be deflected. Suitable arrangements for swivelling or otherwise angling the foot are illustrated in FIGS. 8 and 9. The upper end of the cylinder 67 has a valve inlet aperture 64 to which a pressure line (not shown) is connected. Pressure is supplied via a control unit (not shown) which may operate the pressure in a variety of controlled manners as described hereafter.

A free solid piston 54 is slidably received within the cylinder 67, its upper surface 70 being exposed to pressure introduced through inlet valve 64 and its lower surface 69 being engageable intermittently with a ram head disc 68. An exhaust valve 55 is mounted in the side wall of the cylinder 67 approximately one third of the distance from the upper end of the cylinder 67, as viewed. Shock absorbers 57 are fitted around the ram 58 between the base of the cylinder 71 and the underside of the ram head disc 68. Similar shock absorbers are fitted around the ram 58 between the underside of the cylinder base 71 and the variable weighted foot 59. The function of these shock absorbers is to prevent impact damage between the ram head disc 68 and the cylinder base 71 and between the cylinder base 71 and the variable weighted foot 59.

A control unit (not shown) controls the overall operation of the apparatus. Thus, when the apparatus is in normal pulsing mode, pulses of pneumatic pressure are applied to the pressure inlet valve 64. The magnitude and duration of the pulses may be varied to match the ground and type of mine involved (see later examples). The valve 55 is normally open but can be closed by operation of the control unit should it be necessary to apply a continuous loading on the foot.

The pressure relief valve 65 in FIG. 7 is not shown in the embodiment of FIGS. 1 to 4 merely for ease of illustration. Operation of the valve 65 is determined by the control unit a part of the primary shock absorption system. Thus, in the case of a small mine, such as an anti-personnel mine, the valve 65 would be slightly open to allow controlled release of pressure building in the cylinder above the piston 54. However, in the case of a large explosion, such as an anti-tank mine, the valve 65 would need to be more open to allow for controlled pressure release.

In the event of mine detonation, the ground engaging variable weight foot 59, ram 58 and piston 54 are forced rapidly upwards within the cylinder 67. For the first two thirds of the travel there is no back pressure due to the venting of air through the exhaust valve 55 thus minimising damage to the base of the variable weighted foot 59. Having passed the exhaust valve 55, the piston 54 compresses the air in the remainder of the cylinder 67 thus slowing down and absorbing shock in the manner described with respect to FIG. 4.

The pressure relief valve 65 controls, via the control unit, the release of this build up of compressed air preventing the piston 54 being forced back down. The explosion sensor 63 inhibits, via the control unit, other units in the machine from operating until after the explosion has subsided. During this period the control unit also arrests forward motion of the machine.

The control unit may vary the action of the foot to suit the terrain and circumstances prevailing at the time of use.

In normal use, a series of controlled pressure pulses are applied to the pressure unit valve 64 as previously described, thus causing the foot 59 to strike the ground appropriately. Upon a mine being detonated, the foot 59, the ram 58 and the control arm 66 rise rapidly and the two-way valves 56 and 60 open allowing the air pressure beneath the pistons 61 and 54 respectively to equalize. The pressure created by the rapid rise of the control piston 61 causes actuation of the explosion sensor 63 which passes information to the control unit. Where a plurality of ram and cylinder assemblies are used, for example as illustrated in FIG. 6, the control unit then inhibits all the inlet valves 64, opens all the pressure relief valves 65 and applies inlet pressure to all the two-way valves 60. In this way all the ground-engaging feet are raised to minimize blast damage. Further movement of any apparatus driving vehicle is also halted by the control unit.

Once the blast has died away, the apparatus is reactivated by the control unit.

A fourth embodiment of the invention is illustrated in FIG. 8 and consists of a housing or cylinder 75 within which a ram 79 is mounted for reciprocation or pounding in the manner described previously. The lower end of the ram 79 carries a variable weighted ground engaging foot 80 which is connected to the ram 79 via a pivotal bearing shown diagrammatically at 102. The foot 80 may be fitted in various configurations and sizes to suit the application, terrain and prevailing circumstances. For example, the foot 80 can swivel, angle, or pivot about a point when used against a bounding mine or anti-tank projectile or on rough or undulating terrain. Further, the fact that the full surface area of the foot is not presented to any blast also assists in shock absorption—see also FIG. 11.

The upper end of the cylinder 75 has a valve inlet aperture 93 to which a pressure line (not shown) is connected. Pressure is supplied via a control unit (not shown) which may operate the pressure in a variety of controlled manners. A piston 73 is slidably received within the cylinder 75, its upper surface 92 being exposed to pressure introduced through inlet valve 93 and its lower surface being attached to the ram 79. A pressure dump valve 74 is mounted in the side wall of the cylinder 75 as viewed. Shock absorbers 78 are fitted around the ram 79 between the end wall of the cylinder 77 and the lower surface 83 of the piston 73. Similar shock absorbers 78 are fitted around the ram 79 between the underside of the cylinder end wall 77 and the variable weighted foot. The function of these shock absorbers is to prevent impact damage between the lower surface 83 of the piston 73 and the cylinder base 77 and between the cylinder end wall 77 and the control guide 90.

In the event of a mine detonating under the variable weighted foot 80 the two way valve with pressure sensor 76 detects the sudden increase in back pressure causing the dump valve 74 to open. Thus there is no pressure (other than the weight of the ram and foot assembly) between the variable weighted foot 80 and the explosion. The variable weighted foot 80 together with the ram 79, piston 73 and shock buffer 91 are propelled upwards against zero pressure until the upper surface 92 passes the dump valve 74 where pressure is allowed to build up in the remaining third of the cylinder 75. This pressure is controlled by bleeding the pressure through the pressure relief valve 72 at a predetermined rate thus slowing the upward movement. The shock buffer 91 further reduces the effects of the explosion by damping the upward movement of the assembly as it comes in contact with the upper surface of the cylinder 75. Shock absorbers 78 also come in to play at this time.

Referring now to FIG. 9 which illustrates the fifth embodiment of the invention and which incorporates both secondary and tertiary mounted shock absorption. A cranked arm 100 is pivotally mounted in a bearing 101. The right hand side (as viewed) of the arm supports a reciprocating assembly 95 which carries a ground-engaging foot 96 via a universal foot pivot 102. A secondary shock absorber is fitted between the arm 100 and the reciprocating bearing assembly 95, the secondary shock absorber consisting of a hydraulic damper located within a helical compression spring.

An explosion suppression chamber 97 is mounted on brackets to the main body of the machine, (normally a remotely controlled vehicle). A tertiary shock absorber is mounted between the left hand side (as viewed) as of the cranked arm 100 and the explosion suppression chamber 97. Like the secondary shock absorber, the tertiary shock absorber consists of a hydraulic damper located within a helical compression spring. Whereas FIG. 9 illustrates the use of an explosion suppression chamber, under certain circumstances it may be possible to use a baffle shield in place of a chamber.

A counter balance weight 99 is placed on the left (as viewed) of the pivot 101 to counteract the weight of the apparatus. In the event of a mine exploding, the spring and hydraulic damper of the secondary shock absorber 94 compress allowing for shock arising from the explosion to be absorbed, following which the absorber 94 returns its normal, illustrated, operating position. The secondary shock absorber also has the effect of reducing any tendency for oscillations to develop either during or following the explosion.

In the event of a large mine detonation tertiary shock absorption is affected by a combination of a pivotal arm 100 and tertiary shock absorber assembly 98. The excess energy, above that coped with by the secondary shock absorber assembly 94, causes the pivotal arm to turn anti-clockwise about pivot bearing 101. The resultant force is transmitted to tertiary shock absorber assembly 98 which further reduces the effects of the explosive energy.

The system of secondary and tertiary shock absorption is designed to ensure that the forces generated by the mine detonation zone or the explosion are absorbed and transmitted forwards and not downwards as it is important to maintain the integrity of the pressure on the ground of the weight foot print of the machine. This is particularly important where the machine is being used to clear anti-personnel mines on a first sweep of an area where it is suspected that anti-tank or deeply buried mines lie.

Using control unit the applied force to the ground by the ground engaging foot 96 can be varied ensuring that the mines are detonated and not broken up and that full control of the detonation of various types of mines is maintained. Typically this variation in set pressure for the ground engaging foot will be between 1 kilogram and 400 kilograms. However, it is envisaged that there may be occasions where greater pressures are necessary, an example being where mines have been laid in peat and have sunk to a depth below the surface thus requiring greater than normal pressure to detonate them.

The explosion suppression chamber 97 further suppresses the effects of the mine detonation, particularly in the cases of bounding mines or anti-tank projectiles. Such mines or projectiles are deflected into the explosion suppression chamber where they are encompassed by the shielding and allowed to detonate. The shielding of the explosion suppression chamber may be of different thickness and material but typically would be quarter or half inch armor plate.

Figure 10C:
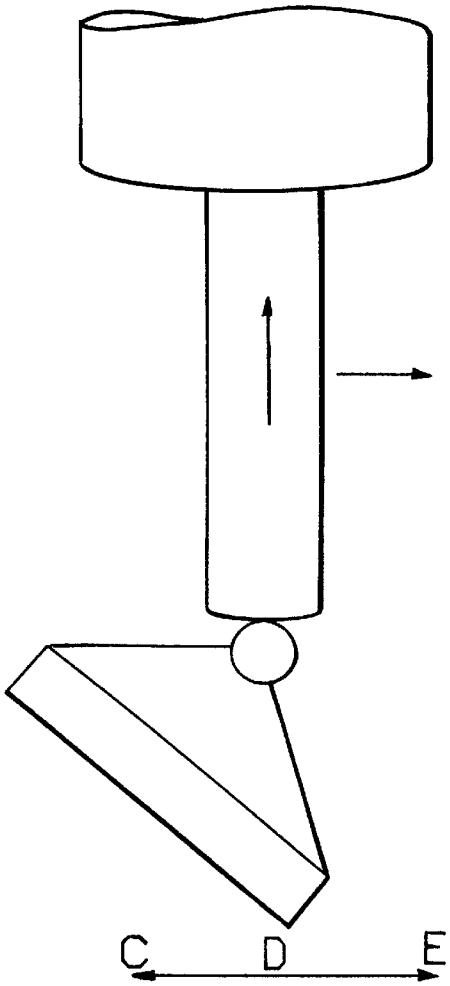
FIGS. 10*a*, 10*b* and 10*c* illustrate sequential operation of the swivelable foot used in the embodiments of FIGS. 8 and 9.
Figure 10B:
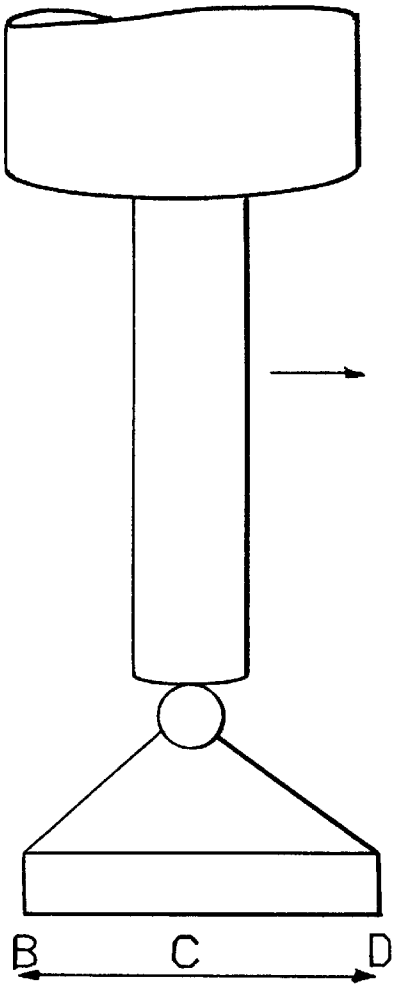
Figure 10A:
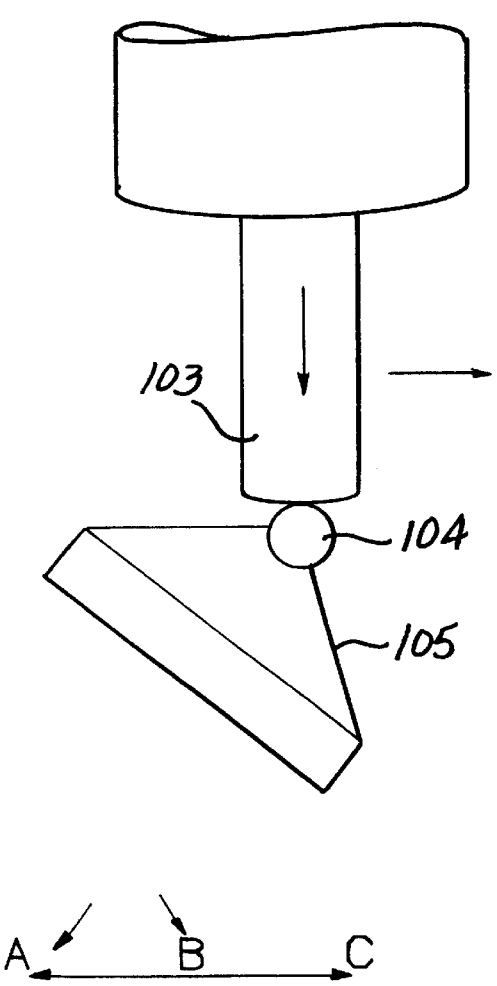

FIGS. 10*a* to 10*c* illustrate the action of the ground engaging foot (105). The combined reciprocating action and the forward motion of the machine are coordinated by the control unit (not shown) in such a manner that the foot strikes each piece of ground a predetermined number of times, usually minimum of twice. FIG. 10*a* shows the ram (103) and ground-engaging foot, having pressed down on area A, B, C has been lifted and is now moving forward ready to strike ground area B, C, D, FIG. 10*b*. The assembly is then raised and moves forward to come down on ground area C, D, E. The universal foot pivot (104), being a universal jointed bearing, allows the foot to take up the vagaries of the ground surface.

An essential feature of the invention is that when a mine explodes under the ground-engaging foot (105) the total pressure applied downwards onto the device comprises of the weight of the ground-engaging foot (105) plus the weight of the ram (103) only as all other downward forces have been released, i.e. there are no hydraulic, pneumatic or mechanical pressure on the ram and foot assembly. Damage caused by explosives is increased by the weight of containment on the explosion. Thus the effects of the explosion on the ground-engaging foot (105) are reduced to a minimum. The ground-engaging foot (105) and ram (103) are driven upwards by the blast and the shock absorbed as previously described.

Figure 11:
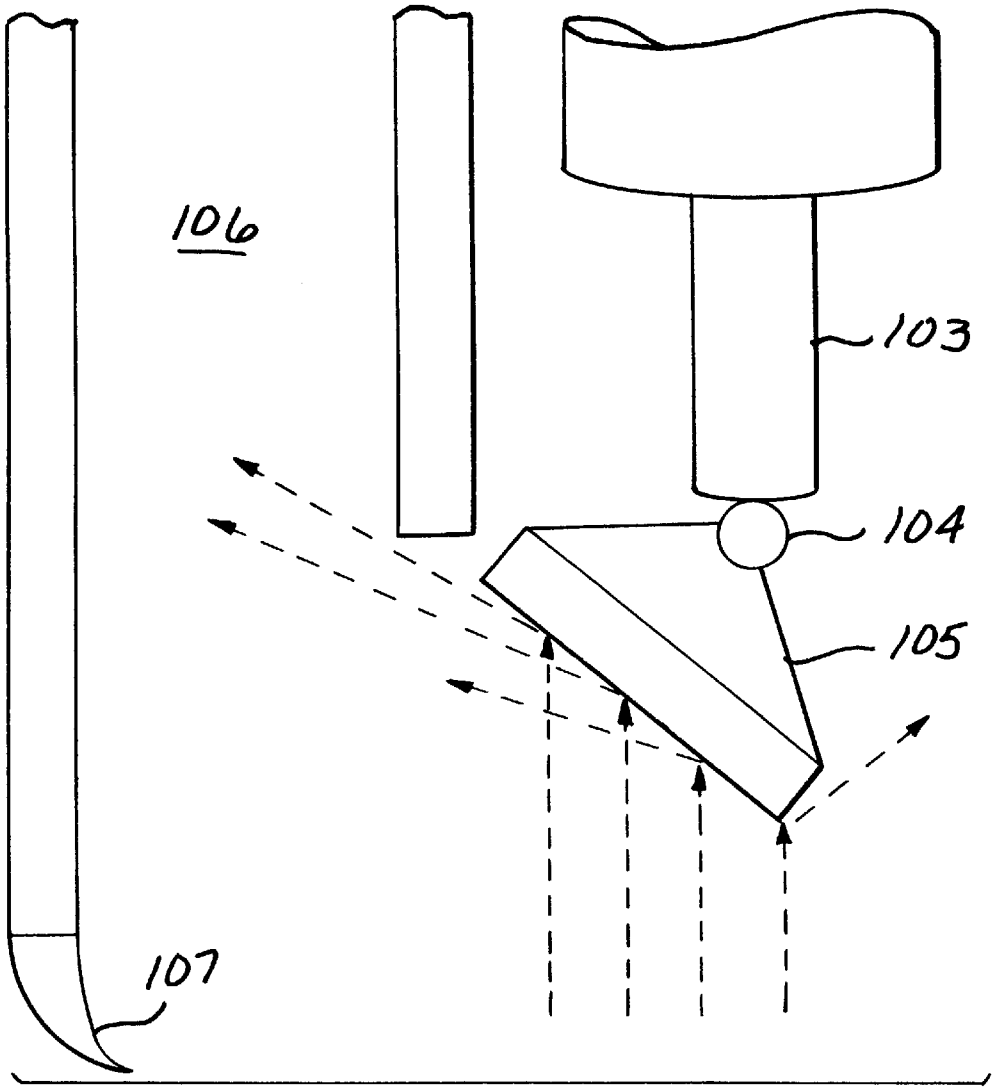
FIG. 11 illustrates the effect of an exploding ordnance upon the foot illustrated in FIGS. 10*a*–10*c*.

Further reduction of the effects of the explosive forces on the ground-engaging foot (105) is achieved by biasing the ground-engaging foot toe down as shown in FIG. 11 thus deflecting blast as the ground-engaging foot (105) leaves the ground. This toe down bias also deflects any projectiles into the mine detonation zone or explosion suppression chamber (106) where they are detonated in a controlled way. As an example of a device such as a bounding mine will fire upwards approximately 1 meter and then explode firing shrapnel in all directions. The shrapnel will be contained within the explosion suppression chamber (106). This secondary firing of shrapnel is usually actuated by a lanyard attached to a base plate affixed in the ground. In the event that the ground-engaging foot fails to deflect the projectile in a manner which allows this secondary firing and the device falls unfired, to the ground, the retaining claw (107) will drag the projectile forward until the lanyard is pulled. The projectile will then detonate within the explosion suppression chamber (106).

EXAMPLES

Example 1

In use, as best seen from FIG. 7, pulses of pressure are applied to the upper surface 70 of the piston 54 thus causing the piston 54 to move downwardly within the cylinder 67 for the extent indicated into contact with the ram head disc 68. Further downward movement continues providing the variable weighted foot 59 with a stamping action simulating the action of a human foot. This action stamps or strikes the ground with sufficient force to activate a mine. This force is controlled by the control unit (not shown) and the weight of the variable weighted foot 59 thus enabling the force to be varied to cope with different types of mine.

As the piston 54 passes the exhaust valve 55 the pressure above the piston is removed whereby the variable weighted foot 59 continues under inertia until it strikes the ground. This allows the variable weighted foot 59 to cope with uneven surfaces and allows the variable weighted foot 59 to be driven upwards against zero resistance if a mine is activated. The pressure relief valve 65 opens when the piston passes the exhaust valve 55 on the upstroke but closes when the pressure inlet valve 64 is opened.

To raise the ram 58 a control piston 61 is used. Pressure is applied through a two way valve 60 raising the ram 58 to the desired height. Pressure above the control piston 61 is vented through vent 62. The pressure under the control piston 61 holds the ram 58 in the desired position. When pressure is applied through inlet valve 64 the two way valve 60 opens releasing the pressure below control piston 61 allowing the ram 58 to be driven down. The cycle is repeated. An explosion sensor 63 is fitted to detect large mines exploding. When a large mine explodes the sensor 63 inhibits the controller stopping further operations of the device until the blast has subsided.

Example 2

Where the ground surface is soft and flat the device may be used in a fast pounding mode. The two way valve 60 is fully open in the venting position throughout this mode allowing the variable weighted foot to start by resting on the ground. Two way valve 56 allows pressure to enter the cylinder 67 beneath the piston 54 pushing it to the top of the stroke. Simultaneously as the pressure beneath the piston 54 is vented through the exhaust valve 55 the pressure inlet valve 64 opens. Pressure applied to the upper surface 70 of the piston 54 drives it down onto the ram head disc 68 thus causing pounding of the ground beneath the variable weighted foot 59. Two way valve 56 now acts a pressure relief valve and opens to release any build up of pressure beneath the piston 54. This cycle repeats at a pace set by the control unit (not shown).

Example 3

When used in water, such as a paddy field, the stamping action is reduced in effect by the drag of the water. Therefore it is necessary to operate the device by placing the variable weighted foot 59 on the floor of the water covered area and then striking the ram head disc 68 with the piston 54. The control unit lowers the ram 58 to the bottom of the water by releasing the pressure, from under control piston 61, through two way valve 60 thus allowing the control piston 61 to move downwards. With the variable weighted foot 59 on the floor two way valve 56 allows pressure to push on the underside 69 of piston 54 pushing it to the top of cylinder 67. As the pressure on the underside 69 of piston 54 is released through exhaust valve 55 pressure is applied to the top surface 70 of piston 54 via pressure inlet valve 64. Pressure relief valve 65 closes and the piston 54 is forced downwards to strike the ram head disc 68. The pressure on the top surface 70 is released through exhaust valve 55. As there is no pressure above the piston 54 it will be allowed to rise and absorb energy if a mine is activated.

In normal operation two way valve 60 will allow pressure under control piston 61 and raise the variable weighted foot sufficiently high enabling the assembly to move forward.

Where a layer of sludge covers the bottom of the water-covered area it may be necessary to apply steady pressure to the top 70 of the piston 54, exhaust valve 55 being closed, forcing the variable weighted foot 59 through the sludge until it reaches the harder floor, detected by a pressure sensor (not shown). With the variable weighted foot 59 in position on the hard floor pressure relief valve 65 and exhaust valve 55 open and the two way valve 56 allows pressure to push on the underside 69 of piston 54 pushing it to the top of cylinder 67. As the pressure on the underside 69 of piston 54 is released through exhaust valve 55, pressure is applied to the top surface 70 of piston 54 via pressure inlet valve 64. Pressure relief valve 65 closes and the piston 54 is forced downwards to strike the ram head disc 68. The pressure on the top surface 70 is released through exhaust valve 55. As there is no pressure above the piston 54 it will be allowed to rise and absorb energy if a mine is activated. In normal operation two way valve 60 will allow pressure under control piston 61 and raise the variable weighted foot sufficiently high enabling the assembly to move forward. The procedure is then repeated.

Example 4

It may be necessary to put extended pressure onto a mine in which case the control unit (not shown) would close the exhaust valve 55 for the period required with an operating sequences similar to the following. Two way valve 60 is opened to release the pressure below control piston 61. The pressure inlet valve 64 opens applying pressure to the top 70 of piston 54 driving it and the ram downwards causing the variable weight foot 59 to strike the ground with a predetermined force. The pressure on 70 is held for a given time before exhaust valve 55 is opened releasing the pressure above the piston 54. Pressure is applied through the two way valve 60 to the base of control piston 61 raising the assembly to a pre-set height. The process is repeated as necessary.

The foregoing description concerns preferred embodiments within which the skilled man will be able to make modifications. For example, the piston could be driven by means other than pneumatics or hydraulics for instance by an air motor or a two or four stroke petrol engine or a diesel engine, through hydrogen or other gas power or electrically.

I claim:

1. An apparatus for detonating a mine comprising a ram and a foot engageable with the ground; power means for applying power to the foot to apply a force to the ground sufficient to detonate a mine; and means for absorbing shock energy created upon detonation of an exploding mine, wherein, the apparatus further includes control means for controlling an application of power to the foot thereby controlling the force applied by the foot to the ground;

wherein, at the moment of an explosion of a mine adjacent the foot, the control means prevents the force from the power means from acting on the ram and the foot so that the force exerted by the apparatus toward the mine consists solely of the weight of the ram and the foot.

2. An apparatus as claimed in claim 1, in which a plurality of ram and cylinder assemblies are provided mounted in side-by-side relationship upon a common frame, said control means operating the assemblies asynchronously to limit blast damage from an exploding mine.

3. An apparatus as claimed in claim 1 wherein said apparatus is at least one of driven by a vehicle and mounted on a vehicle.

4. An apparatus as claimed in claim 1, wherein the control means controls the application of power to the foot by at least one of pulsing the power applied to the foot and applying a steady pressure for a chosen period.

5. An apparatus according to claim 1, wherein the power means is for reciprocating the foot.

6. An apparatus as claimed in claim 1, including a mine detonation zone or area formed between two armor plated shields.

7. An apparatus as claimed in claim 1, further comprising a primary shock absorber and a secondary shock absorber including a hydraulic damper located within a helical spring and a pivotally mounted cranked arm having a pivot point and a pair of limbs extending therefrom, wherein whenever said hydraulic damper is mounted on one limb of the pivotally mounted cranked arm, the other limb mounts one of an explosion suppression chamber and baffle shield by way of a tertiary shock absorber, such that shock created by detonation of a large mine is absorbed by the primary, secondary and tertiary shock absorbers in combination with the cranked arm which is caused to rotate, by the explosion, about the pivot point in a direction determined by lifting of the ground-engaging foot.

8. An apparatus for detonating a mine comprising a ground-engaging foot, power means for reciprocating said foot, control means for controlling the application of power at selectable intervals to the foot thus the manner for reciprocating the foot, and means for absorbing shock energy created upon detonation of an exploding mine, wherein the power means is for reciprocating the foot and comprises a ram and cylinder assembly formed by a ram and a cylinder, the cylinder having a cylindrical wall and containing a free-moving piston, means for applying pressure to an upper surface of the piston to cause the piston to move downwardly within the cylinder, movement of the piston also extending the ram to move the foot into ground-engaging contact, and an exhaust valve being located in the cylindrical wall of the cylinder approximately one third from an upper end of the cylinder.

9. An apparatus as claimed in claim 8 further including a primary shock absorber including the piston moving rapidly upwards within said cylinder upon detonation of a mine causing an explosion, and covering the exhaust valve, and continuing upward movement of the piston compressing the fluid above the piston, thus causing a slowing of the piston and enabling blast from the explosion to be absorbed.

10. An apparatus as claimed in claim 9 in which a pressure relief valve is provided in the upper part of the cylinder to assist in shock absorption by controlling the slowing of the piston.

11. An apparatus as claimed in claim 9, further comprising a secondary shock absorber including a hydraulic damper located within a helical spring and a pivotally mounted cranked arm having a pivot point and a pair of limbs extending therefrom, wherein whenever said hydraulic damper is mounted on one limb of the pivotally mounted cranked arm, the other limb mounts one of an explosion suppression chamber and baffle shield by way of a tertiary shock absorber, such that shock created by detonation of a large mine is absorbed by the primary, secondary and tertiary shock absorbers in combination with the cranked arm which is caused to rotate, by the explosion, about the pivot point in a direction determined by lifting of the ground-engaging foot.

12. An apparatus as claimed in claim 8 including a mine detonation zone or area formed between two armour plated shields.

13. An apparatus as claimed in claim 12 in which the shields are curved or otherwise profiled to direct any blast damage upwardly away from the apparatus.

14. An apparatus as claimed in claim 8 in which the foot is pivotally mounted to the ram.

15. An apparatus as claimed in claim 14 in which the foot is biased "toe-down" for at least one of to minimize the effect of an explosion on the foot and to deflect one of a bounding mine and projectile into one of a mine detonation zone and an explosion suppression chamber.

16. An apparatus as claimed in claim 8 in which the ram and cylinder assembly is mounted upon a secondary shock absorber.

17. An apparatus as claimed in claim 16 in which the secondary shock absorber comprises a hydraulic damper located within a helical spring.

18. A method of detonating a mine comprising the steps of:

applying a force to the ground via a moveable foot, engageable with the ground, so that when the force is applied, the force is sufficient to detonate a mine to cause an explosion and absorbing shock energy created upon detonation of the mine;

applying and controlling power to, hence the force applied by, the foot during application of the force, to cause detonation of a mine; and at the moment of the explosion of the mine under the foot, preventing the force from the power means from acting on the foot so that the force exerted by the apparatus toward the mine consists solely of the weight of the ram and the foot.

19. A method according to claim 18 wherein the step of applying power to the foot results in reciprocatory motion of the foot.

20. A method as claimed in claim 19 in which the movable foot is secured to the ram of a ram and cylinder assembly so that the moveable foot is reciprocated upon reciprocation of the ram, the ram being activated by the supply of pressure pulses of fluid thereto.

21. A method as claimed in claim 20 which additionally comprises the step of mounting the ram and cylinder assembly upon a secondary shock absorber which absorbs part of the shock energy created by an exploding mine.

22. A method as claimed in claim 21 which comprises the further steps of mounting the ram and cylinder assembly upon a pivotally mounted cranked arm, wherein said cranked arm has a pair of limbs and said assembly is mounted on one of the limbs, and mounting an explosion suppression baffle on the other limb by way of a tertiary shock absorber, and absorbing shock created by detonation of a large mine by a primary, the secondary and the tertiary shock absorbers in combination with pivotal action of the cranked arm.

23. A method as claimed in claim 19 which further comprises the step of controlling amplitude and frequency of the reciprocatory motion of the foot in dependence upon ground conditions.

24. A method as claimed in claim 19, which comprises the additional step of confining an exploding mine within a mine detonation zone.

25. A method according to claim 19 wherein the step of applying power to the foot includes the steps of applying an initial force via the foot and subsequently increasing the force applied via the foot.

* * * * *

UNITED STATES PATENT AND TRADEMARK OFFICE

CERTIFICATE OF CORRECTION

PATENT NO. : 5,979,289

DATED : November 9, 1999

INVENTOR(S) : John Robert French

It is certified that error appears in the above-identified patent and that said Letters Patent is hereby corrected as shown below:

In column 12, after line 50 add:

26. A method according to claim 18, wherein the force applied by the foot is controlled by one step selected from the group of:

i) pulsing the power applied to the foot;
ii) applying an initial, steady pressure followed by a further, greater, steady pressure; and
iii) applying a steady pressure for a chosen period.

Signed and Sealed this

First Day of August, 2000

*Attest:*

Q. TODD DICKINSON

*Attesting Officer*

*Director of Patents and Trademarks*